US010094177B2

(12) United States Patent
Bjoerneklett et al.

(10) Patent No.: US 10,094,177 B2
(45) Date of Patent: Oct. 9, 2018

(54) MARINE RISER

(71) Applicant: MARITIME PROMECO AS, Kristiansand S (NO)

(72) Inventors: Boerge Bjoerneklett, Eiksmarka (NO); Per Martin Erik Hansson, Kullavik (SE); Henrik Alfredsson, Moelndal (SE); Niklas Persson, Gothenburg (SE)

(73) Assignee: MARITIME PROMECO AS, Kristiansand S (NO)

( * ) Notice: Subject to any disclaimer, the term of this patent is extended or adjusted under 35 U.S.C. 154(b) by 0 days.

(21) Appl. No.: 15/517,517

(22) PCT Filed: Sep. 16, 2015

(86) PCT No.: PCT/NO2015/050161
§ 371 (c)(1),
(2) Date: Apr. 7, 2017

(87) PCT Pub. No.: WO2016/056918
PCT Pub. Date: Apr. 14, 2016

(65) Prior Publication Data

US 2017/0306706 A1 Oct. 26, 2017

(30) Foreign Application Priority Data

Oct. 10, 2014 (NO) ..... 20141222

(51) Int. Cl.
*E21B 17/01* (2006.01)
*E21B 36/00* (2006.01)

(52) U.S. Cl.
CPC ..... *E21B 17/01* (2013.01); *E21B 36/001* (2013.01)

(58) Field of Classification Search
CPC ..... E21B 17/012; E21B 17/01; E21B 36/001
USPC ..... 166/367
See application file for complete search history.

(56) References Cited

U.S. PATENT DOCUMENTS 4,634,314 A * 1/1987 Pierce ..... F16L 9/14 166/350
5,192,039 A * 3/1993 Williams ..... F16L 59/135 138/107
5,711,639 A * 1/1998 Tessier ..... E21B 17/012 24/285
5,803,161 A * 9/1998 Wahle ..... F28D 15/0233 165/104.21
6,092,557 A * 7/2000 Sumner ..... F16L 59/14 138/140
6,267,172 B1 * 7/2001 McClung, III ..... E21B 17/01 126/612
6,401,825 B1 * 6/2002 Woodrow ..... B63B 21/502 166/350

(Continued)

FOREIGN PATENT DOCUMENTS

GB 2509167 A 6/2014
WO WO 2012/173985 A1 12/2012

(Continued)

*Primary Examiner* — James G Sayre
(74) *Attorney, Agent, or Firm* — Norman B. Thot

(57) ABSTRACT

A marine riser includes at least two riser sections which are connected in an end-to-end relationship. The at least two riser sections extend between a subsea installation and a suspension device arranged above the subsea installation. At least one of the at least two riser sections includes at least one pipe having a heat exchanger.

23 Claims, 8 Drawing Sheets

(56) References Cited

U.S. PATENT DOCUMENTS

| | | | | |
|---|---|---|---|---|
| 6,564,011 | B1 * | 5/2003 | Janoff | E21B 36/04 292/479 |
| 2002/0146287 | A1 * | 10/2002 | Allen | B63B 21/502 405/211 |
| 2003/0209340 | A1 | 11/2003 | McClung, III | |
| 2005/0109513 | A1 * | 5/2005 | Dailey | E21B 17/012 166/350 |
| 2008/0257436 | A1 * | 10/2008 | Caro | B01F 5/0646 137/808 |
| 2010/0086365 | A1 | 4/2010 | Pellen | |
| 2010/0300699 | A1 * | 12/2010 | Papon | E21B 17/01 166/367 |
| 2010/0329908 | A1 | 12/2010 | Martinez et al. | |
| 2012/0097362 | A1 | 4/2012 | Kanstad et al. | |
| 2014/0326504 | A1 * | 11/2014 | Hay | E21B 36/04 175/17 |
| 2015/0013539 | A1 | 1/2015 | Eriksen et al. | |
| 2015/0345275 | A1 | 12/2015 | Sathananthan et al. | |

FOREIGN PATENT DOCUMENTS

| | | | |
|---|---|---|---|
| WO | WO 2013/105951 | A1 | 7/2013 |
| WO | WO 2013/124336 | A2 | 8/2013 |
| WO | WO 2014/049024 | A2 | 4/2014 |

* cited by examiner

MARINE RISER

CROSS REFERENCE TO PRIOR APPLICATIONS

This application is a U.S. National Phase application under 35 U.S.C. § 371 of International Application No. PCT/NO2015/050161, filed on Sep. 16, 2015 and which claims benefit to Norwegian Patent Application No. 20141222, filed on Oct. 10, 2014. The International Application was published in English on Apr. 14, 2016 as WO 2016/056918 A1 under PCT Article 21(2).

FIELD

The present invention relates generally to marine risers.

BACKGROUND

Devices and procedures for production of hydrocarbons from subterranean reservoirs below a seabed have previously been described. In one such procedure, a floating drilling or/and production vessel is positioned above a wellhead on the seabed with a riser extending between the vessel and the wellhead. The riser must be suspended by the vessel at all times in order to prevent it from buckling. Over the years, technological advances have made it possible to extract hydrocarbons from subsea reservoirs at considerable water depths. Today, operations at water depths exceeding 3000 meters are not uncommon.

A marine drilling riser comprises a number of successive sections, which are often referred to as "riser joints". Individual marine riser joints typically vary in length from 10 to 90 feet (approximately 3 to 27 meters) and are stacked vertically or horizontally on the drilling vessel. During deployment into the sea, with assistance of the vessel's hoisting equipment, the joints are interconnected to form a continuous riser string stretching from a blow-out preventer (BOP) and the Lower Marine Riser Package (LMRP) on the subsea wellhead to the drilling vessel. Depending on water depth, a riser string may consist of only a few joints, or up to more than a hundred individual joints.

A riser joint is typically made up of a main pipe and external auxiliary pipes, all having connectors at each respective end. The main pipe is configured to convey drilling fluid, while auxiliary pipes, often referred to as "kill and choke lines", are used to circulate fluids between the drilling vessel and the BOP in a manner which is per se well known in the art.

A considerable riser mass must be supported by the floating vessel when operating in water depths of around 3000 meters and beyond. Drilling operators and oil companies therefore always seek to reduce the size and weight of the riser joint components. However, because some of the auxiliary pipes (notably the kill and choke lines) convey fluids that are under considerable pressure, their wall thickness and strength must have a certain magnitude. While riser joint pipes traditionally have been made from various steel grades, in an effort to reduce weight, recent developments have yielded riser joint with pipes made of carbon-reinforced composite materials.

Drilling equipment is normally subjected to elevated temperatures arising from geothermal heating or through circulation of hot hydrocarbons from the reservoir. Although drilling fluid is entered from the top at ambient temperature, the fluid is heated as it circulates through the drill pipe, via the drill bit, and returns back through the well bore. In subsea drilling, the heated drill fluid may in turn heat up the subsea marine drilling riser which is suspended between the BOP, LMRP, and the floating drilling vessel. Depending on the well conditions and the reservoir in question, expected temperatures may exceed the certified temperature rating of the equipment. More heat resistant riser structures and materials are therefore needed for specific operations. The riser auxiliary pipes may also be exposed to elevated temperatures, particularly when circulating out hydrocarbons arising from a kick in the well. Riser joints having pipes made of carbon-reinforced composite materials (for example, carbon-reinforced epoxy) are therefore generally unsuitable for such high-temperature conditions.

SUMMARY

In an embodiment, the present invention provides a marine riser which includes at least two riser sections which are connected in an end-to-end relationship. The at least two riser sections are configured to extend between a subsea installation and a suspension device arranged above the subsea installation. At least one of the at least two riser sections comprises at least one pipe which comprises a heat exchanger.

BRIEF DESCRIPTION OF THE DRAWINGS

The present invention is described in greater detail below on the basis of embodiments and of the drawings in which.

DETAILED DESCRIPTION

Figure 1:
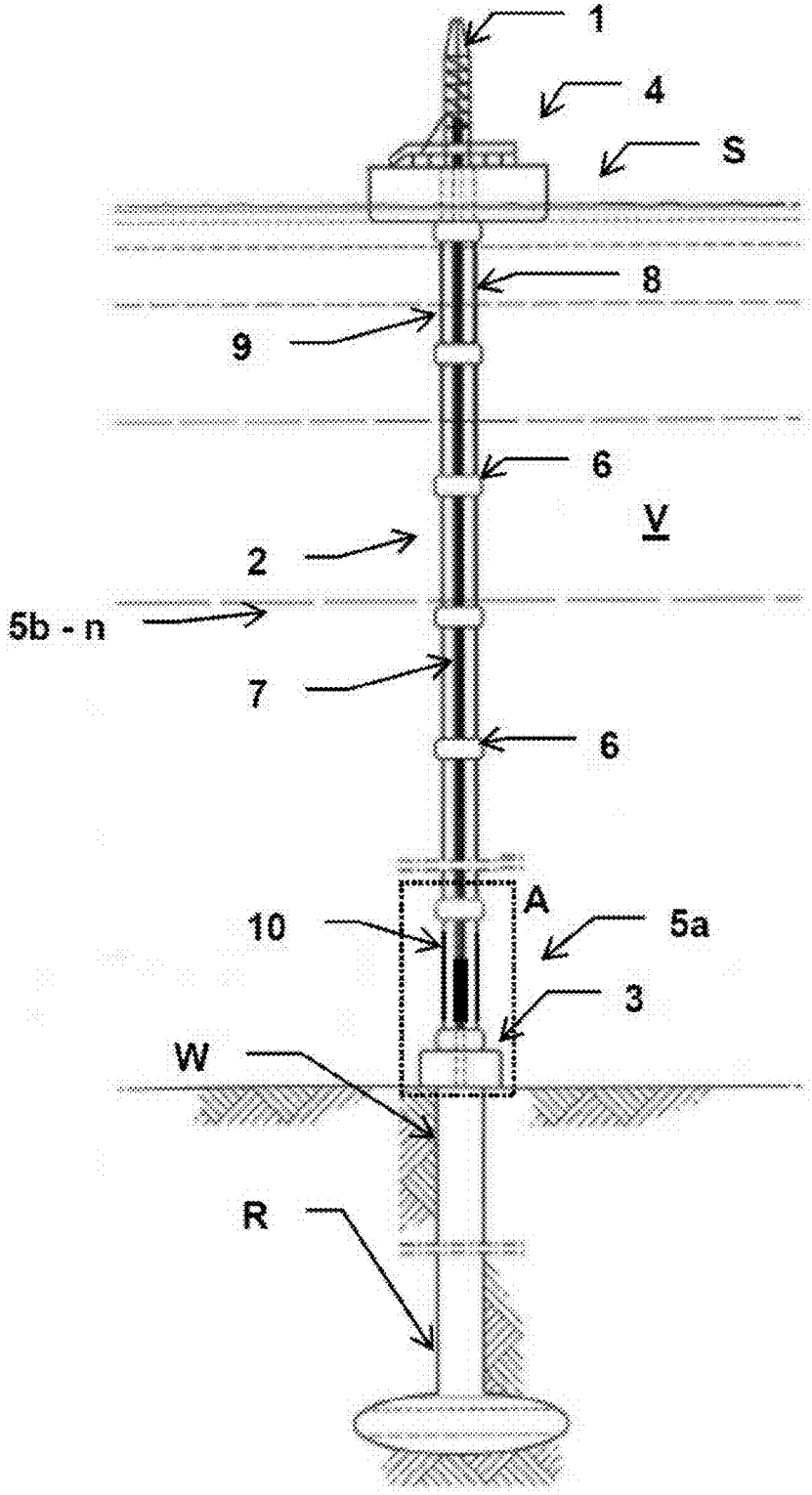
FIG. 1 shows a schematic illustration of a floating vessel suspending a marine riser furnished with cooling devices according to the present invention.

The present invention thus provides a marine riser comprising one or more riser sections connected in an end-to-end relationship which is configured to extend between a subsea installation and a suspension means above the subsea installation, where at least one riser section comprises at least one pipe, wherein at least one of the pipes comprises a heat exchanger device.

In an embodiment of the present invention, the heat exchanger device can, for example, be releasably connected to the at least one pipe. In an embodiment of the present in invention, the heat exchanger device can, for example, comprise a support casing which is configured for assembly on at least a portion of the at least one pipe. The support casing can, for example, comprise a tubular body. The support casing can, for example, comprise two casing halves which are interconnectable via a connection to form a tubular body. In an embodiment, the heat exchanger device can, for example, comprise a support casing having a plurality of radially extending fins. A covering element may be arranged circumferentially around the radially outer ends of the fins.

In an embodiment of the present invention, the heat exchanger device can, for example, comprise a plurality of branch pipes which are fluidly connected to at least one of the pipes. In an embodiment, a heat exchanger device of the first embodiment can, for example, be fitted to at least a portion of at least one of the branch pipes.

In a configuration for operation in conjunction with a high-temperature well, the heat exchanger device can, for example, be fitted to one or more of the pipes of a first riser section which is located closer to the subsea installation than the remaining riser sections.

In an embodiment of the present invention, the pipes of the first riser section can, for example, comprise a metal material, and the pipes of the remaining riser sections can, for example, comprise a composite material. The pipes of the first riser section may comprise aluminum or steel, and the pipes of the remaining riser sections may comprise carbon-reinforced polymers, such as epoxy.

In an embodiment of the present invention, the pipes are a main pipe and kill-and-choke lines, respectively, and each riser section is furnished with such pipes.

The present invention mitigates the problems associated with the prior art by including one or more subsea cooling devices in the riser in order to reduce the temperature load on the riser structure. Maintaining a low temperature throughout the riser has multiple advantages. First of all, it is thereby possible to avoid de-rating the normal yield strength for the high strength steel pipes, thereby enabling a higher utilization of the material and a more slender pipe design. Secondly, most corrosion mechanisms are accelerated under elevated temperature so that maintaining lower temperatures improves the general lifetime of the riser. Because epoxy type paint coatings may deteriorate quicker during elevated temperatures, lowered temperatures also serve to prevent such detrimental influences on the coating. Reduced temperature will therefore have a positive effect on the longevity of the pipes. Another benefit of stable low temperatures can be achieved by avoiding large fluctuations in pipe stress caused by linear thermal expansion of individual pipes. This is particularly important when utilizing load sharing between individual parallel pipes.

Providing low operating temperature is also beneficial with respect to the polymeric seals which are typically rated for normal temperature drilling conditions.

The present invention also makes it possible to use riser joints having pipes of light-weight carbon reinforced composite materials; pipes that otherwise would be unsuitable for high-temperature wells. When one or more of the lowermost riser joints comprise the heat exchanger device of the present invention, pipes of composite materials (for example, carbon-reinforced polymers, such as epoxy) in the remaining riser joints become an attractive alternative to carbon steel pipes in ultra-deep riser applications, particularly for high-pressure (HP) wells where the steel pipe walls would become prohibitively thick and heavy. These wells are often accompanied with high temperatures (HT). The typical epoxy resin in carbon reinforced composite piping has limited temperature resistance. Efficient thermal design utilizing the heat exchanging device of the present invention to lower the temperature in the lower region of the riser will also enable the use of low cost polymer resins in the composite pipes which are situated above the joints having the heat exchanger device and the substantial parts of the HT/HP drilling riser. It is thereby possible to avoid overly expensive polymer alternatives such as, for example, PEEK based resin material in the reinforcing layers of composite pipes.

The heat exchanging device of the preset invention is not only limited for newbuilds, but can also be used for easy modification and enhancement of the HT operating window for existing riser constructions.

The present invention may be used in combination with devices to avoid potential problems with hydrate formation. Hydrate formation is typically combated by using glycol containing fluids, either present in the kill line or in a separate chemical injection line.

These and other characteristics of the present invention will become clear from the following description of a non-restrictive embodiment which set forth in the drawings.

The following description may use terms such as "horizontal", "vertical", "lateral", "back and forth", "up and down", "upper", "lower", "inner", "outer", "forward", "rear", "above", "below", etc. These terms generally refer to the views and orientations as shown in the drawings that are associated with a normal use of the present invention. The terms are used for the reader's convenience only and are not intended to be limiting. In the following description, the term "axial" shall be understood to refer to the longitudinal direction of the marine riser, as indicated by the axial centerline $C_L$ in FIG. 2. The term "radial" shall be understood to refer to the radial extension of the components being described, i.e., any plane perpendicular to the centerline $C_L$.

FIG. 1 illustrates a floating drilling vessel 4 suspending a drilling riser 2 by a derrick 1. The riser 2 extends from the vessel 4, through a body of water V, and connects to a wellhead 3, normally comprising a blow-out preventer (BOP; not shown in the drawings). The riser 2 thus forms a conduit between the vessel 4 and a well W, which in turn connects with a subterranean hydrocarbon reservoir R. The riser 2 is made up by a number of successive sections 5*a-n* (often referred to as "riser joints") whose adjacent ends are connected on board the vessel 4 as the riser 2 is being lowered towards the wellhead 3. Each riser joint 5*a-n* comprises a main riser pipe 7 and external auxiliary pipes (or lines) 8, 9. The riser joints are connected in an end-to-end relationship by connector assemblies 6. The main riser pipe 7 is configured for conveying drilling fluids and well fluids, while the auxiliary pipes 8, 9 in the shown embodiment are so-called "kill and choke lines", respectively. Other auxiliary pipes (not shown in FIG. 1), such as hydraulic lines or booster lines, are also normally connected to the riser joint. Kill and choke lines generally differ from other auxiliary pipes because they need to withstand high internal pressures and are consequently designed with relatively thick walls.

The wall thicknesses of, for example, the booster line and the hydraulic line, need not be particularly large in that these pipes are designed to be operated under comparably lower pressures. Each riser joint may conveniently be provided with one or more buoyancy modules (not shown).

Figure 2:
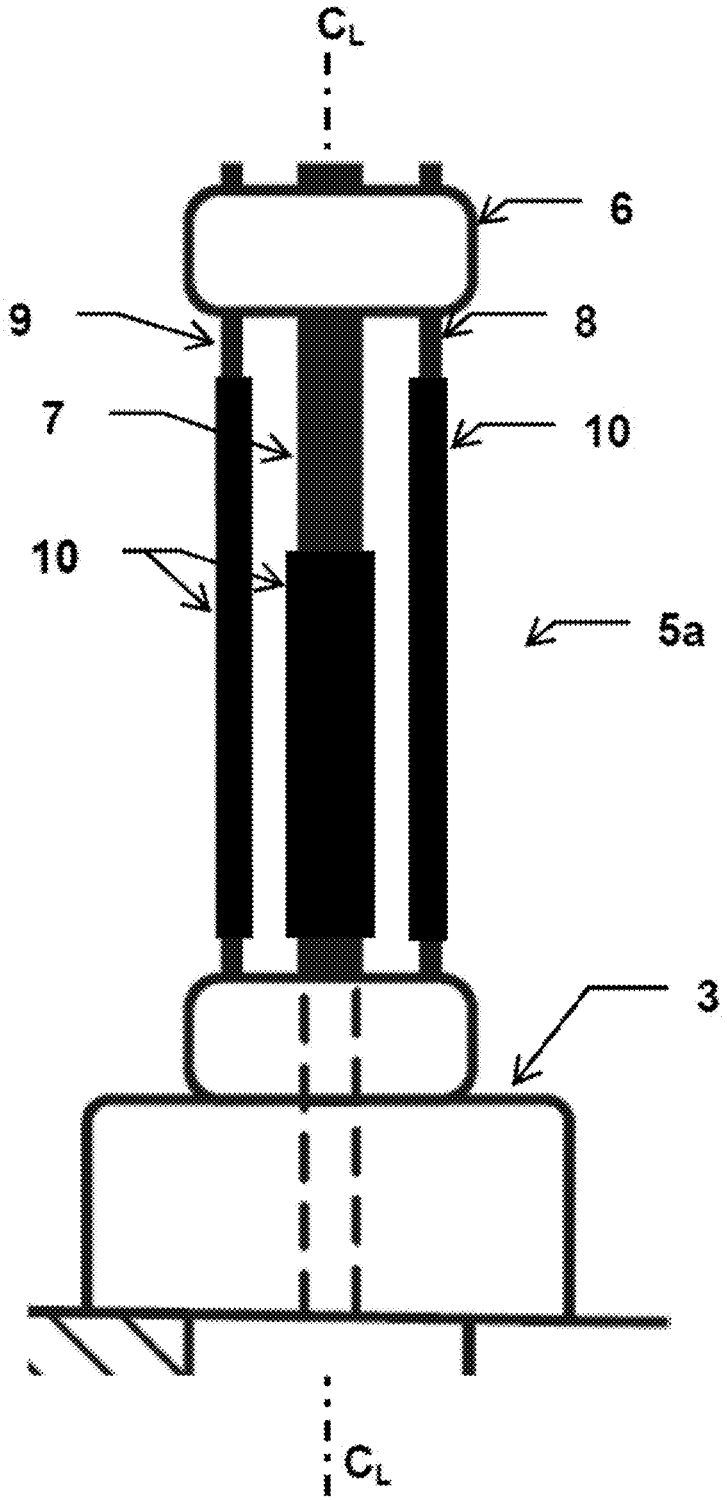
FIG. 2 shows an enlargement of the box marked "A" in FIG. 1.

Referring additionally to FIG. 2, which is a principle sketch of the lowermost riser joint (i.e., closest to the wellhead 3), labeled 5*a*, cooling devices 10 are assembled on portions of the auxiliary pipes 8, 9 and a portion on the main riser pipe 7. In the shown embodiment, each cooling device 10 does not cover its entire respective pipe, but extends only an axial distance on the pipe onto which it is assembled. It should be understood, however, that the axial extension of each cooling device 10 may be determined and adapted for each application, and that each cooling device 10 may cover the entire main riser pipe 7 or auxiliary pipe 8, 9 onto which it is connected. The cooling devices 10 are in fact heat exchangers (for example, heat sinks in the illustrated subsea application) and will therefore occasionally also be referred to as such below. The heat exchangers 10 can, for example, be attached to the lowermost riser joint 5*a*, proximal to the BOP, where the drilling fluids and well fluids have the highest temperatures. The heat exchangers 10 are mounted directly onto the riser pipes in order to efficiently dissipate heat from the drilling fluid into the surrounding seawater. The heat exchangers 10 can, for example, be mounted onto slick riser joints that do not contain floatation elements. Although the drawings show the heat exchangers 10 assembled onto the riser joint located directly above the BOP, it should be understood that heat exchangers 10 may be assembled onto more than one riser joint.

Figure 3:
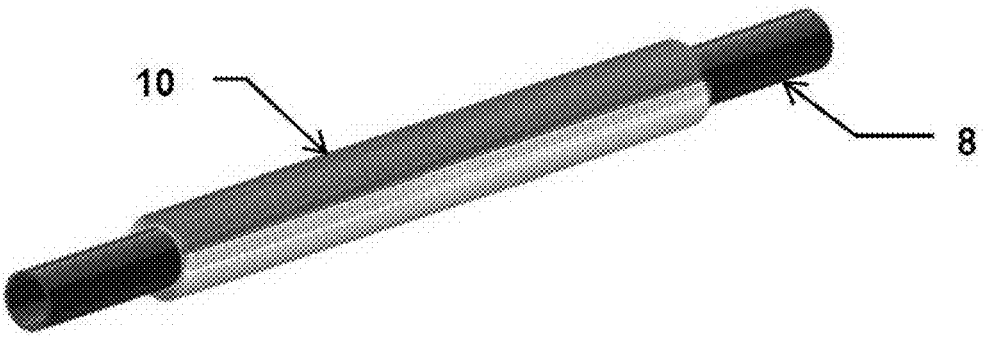
FIG. 3 shows a schematic perspective drawing of a first embodiment of the cooling device of the present invention assembled on a tubular element, such as an auxiliary pipe or a main riser pipe.

FIG. 3 shows one embodiment of the heat exchanger 10 of the present invention assembled onto a portion of an auxiliary pipe 8. It should be understood that similar types of heat exchangers 10 may be assembled on other auxiliary pipes 8, 9 or the main riser pipe 7. However, as the cooling requirements for the auxiliary pipes 8, 9 (notably the kill and choke lines) in many cases differ from those of the main riser pipe 7, the actual dimensions (for example, axial and radial dimensions) of each heat exchanger 10 may vary depending onto which pipe it is to be assembled. While an objective is to lower fluid temperatures, the heat exchanger 10 must also be dimensioned so that only a suitable temperature reduction is obtained, and that hydrate formation does not occur.

Figure 9:
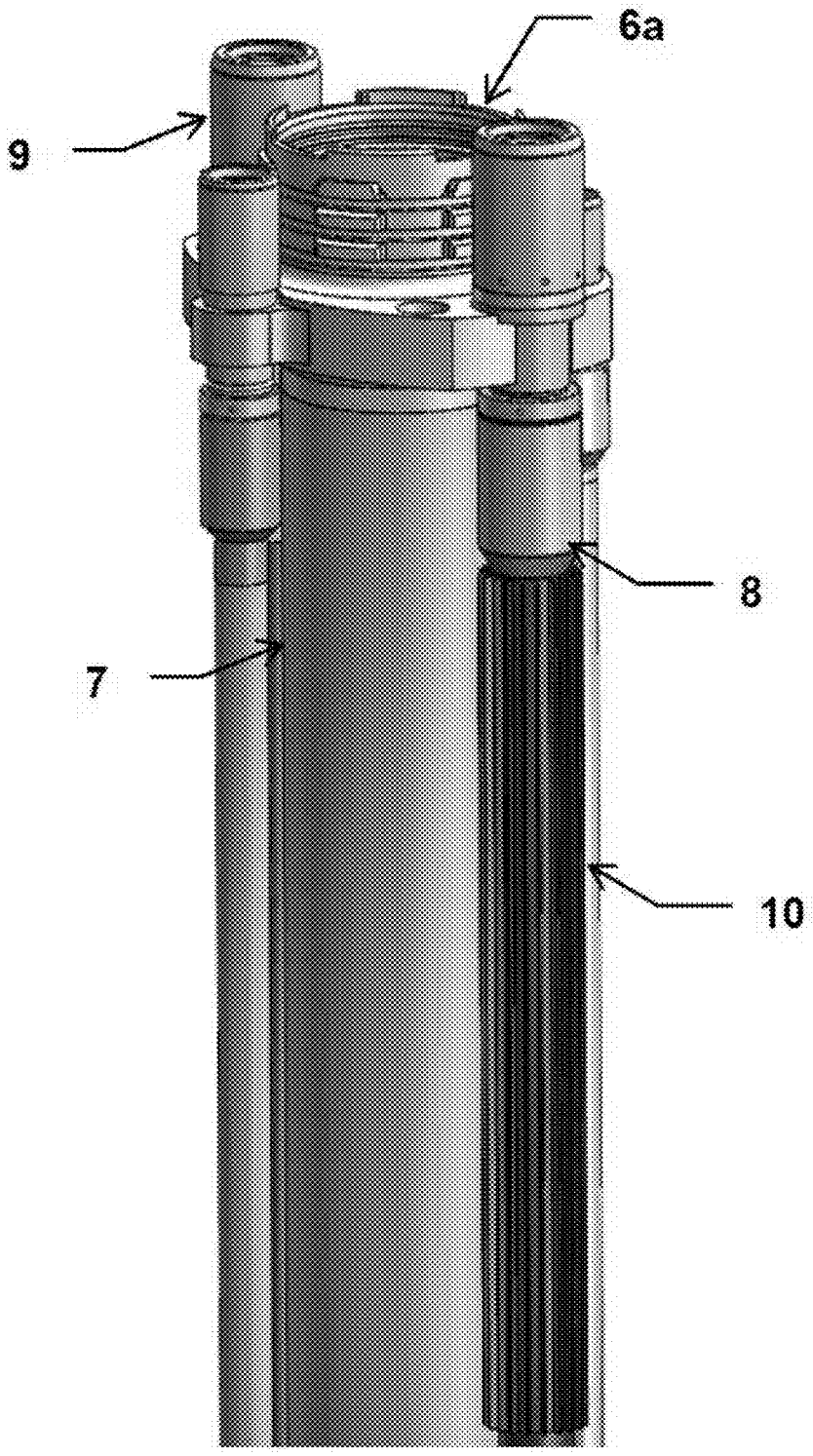
FIG. 9 shows a perspective view of a portion of a riser joint having an embodiment of the cooling device of the present invention connected to one of the auxiliary lines.

FIG. 9 illustrates the heat exchanger 10 assembled on an auxiliary line 8 on a riser joint. FIG. 9 also shows a second auxiliary line 9, the main riser pipe 7, and a portion of the riser joint connector assembly 6*a*.

Figure 4:
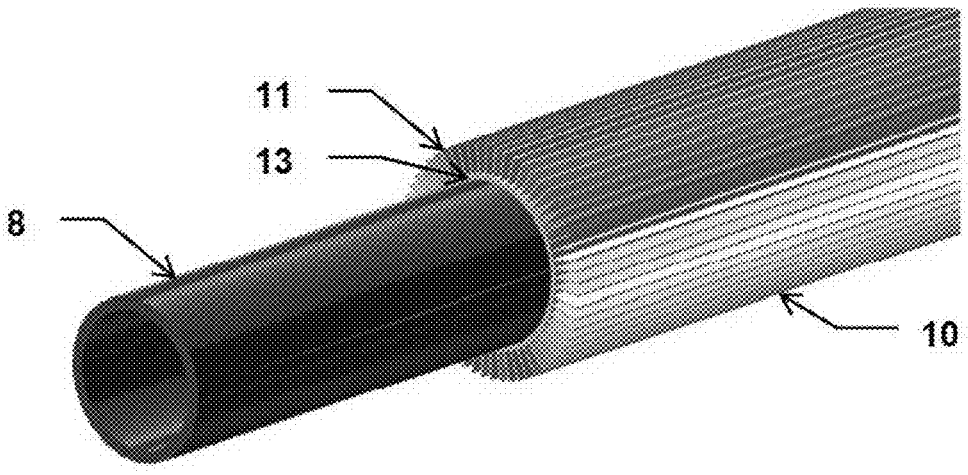
FIG. 4 shows an enlargement of a left-hand portion of FIG. 3.
Figure 6:
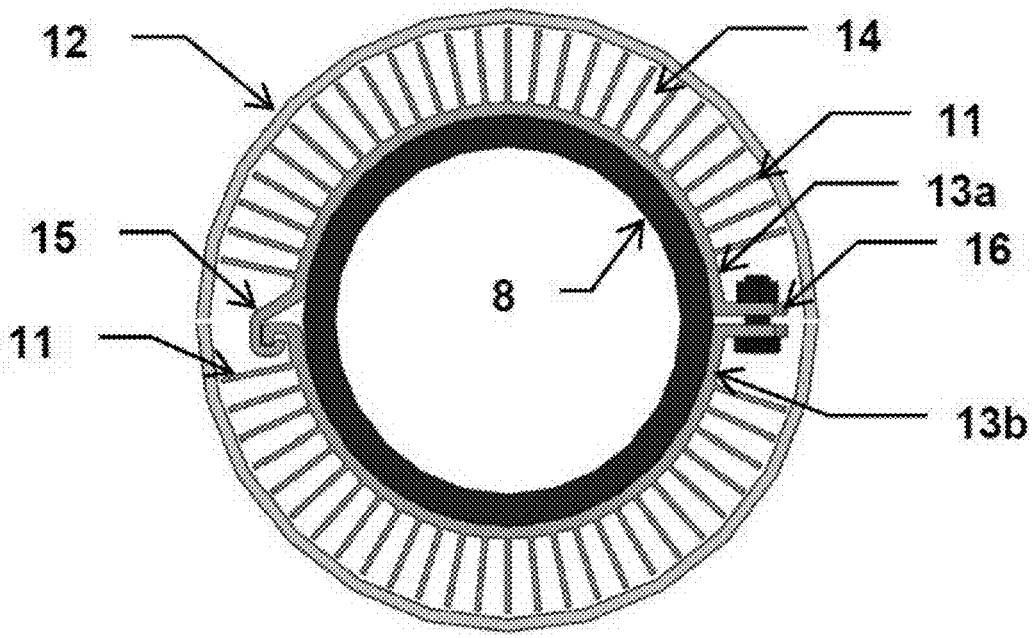
FIG. 6 shows an end view of an embodiment of the cooling device of the present invention assembled onto a tubular element.

Referring additionally to FIG. 4, the heat exchanger 10 comprises a support casing 13 in the shape of a tubular member which is assembled directly onto the auxiliary pipe 8, i.e., in a manner which provides good thermal conductivity between the auxiliary pipe 8 and the support casing 13. Extending radially from the support casing 13 are a plurality of cooling fins 11, extending also in an axial direction along the support casing 13. In the shown embodiment, the cooling fins 11 and support casing 13 are cast as a unitary, integral, aluminum element. The shown embodiment of the heat exchanger 10 (i.e., the support casing 13 and cooling fins 11) is designed from elongated extruded aluminum profiles equipped with cooling fins 11. Other materials with good thermal conductivity are also conceivable. The support casing 13 may be clamped directly onto the carbon steel riser pipe as shown, for example, in FIG. 6. The support casing 13 is here made up by two support casing halves 13*a,b* that are interconnected via a releasable hinge 15 and a bolt 16. Although not shown in FIG. 6, it should be understood that the hinge 15 can, for example, run along the entire axial length of the casing halves 13*a,b*, and that bolts 16 can, for example, be provided at regular intervals along the axial length of the casing halves 13*a,b*. The embodiment shown in FIG. 6 is particularly useful in retrofitting applications.

A thermally conductive paste or similar can be applied between the heat exchanger 10 and the riser pipe to enhance heat transfer. Aluminum profiles can alternatively be shrink fitted onto the riser pipe to facilitate a tight metal-to-metal contact and to minimize thermal barriers. The cooling fins 11 may or may not be equipped with louvers to further increase the cooling effect. The number of heat exchangers 10 and their length may vary depending on the well in question and the desired cooling effect. The surface area of the pipes that are not in direct contact with the cooling device 10 are typically coated in a manner which is known in the art.

The actual shape and geometry of the heat exchanger 10 may take different shapes and forms than the one illustrated without deviating from the present invention.

Figure 5:
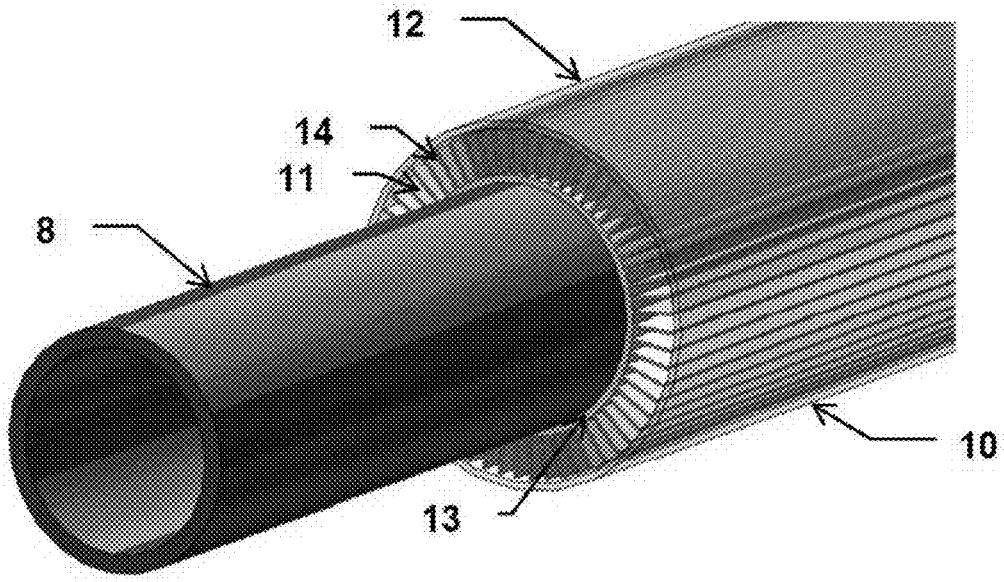
FIG. 5 shows a schematic perspective drawing of a second embodiment of the cooling device of the present invention assembled on a tubular element, such as an auxiliary pipe or a main riser pipe.

The vertical orientation of the pipes creates a favorable chimney effect that increase the water flow rate which, in turn, have a positive effect on the heat transfer coefficient of the surface of the heat exchanger 10. To avoid a potential disruption of the vertical convection, the cooling device 10 may be equipped with a protection cover 12 around the perimeter of the cooler. This is shown in FIG. 5. The embodiment of the cooling device 10 of the present invention, in which a protection cover 12 in the shape of a tubular element is arranged around the outer ends of the cooling fins 11, thereby defines a plurality of parallel channels 14 extending in the axial direction of the cooling device 10. When the riser joint is placed upright in the sea, water within the channels 14 will be heated and thus flow upwards, whereby cooler seawater will enter the channels 14 from below. The channels 14 therefore serve to circulate cooling liquid (i.e., seawater) through the cooling device 10.

Figure 7:
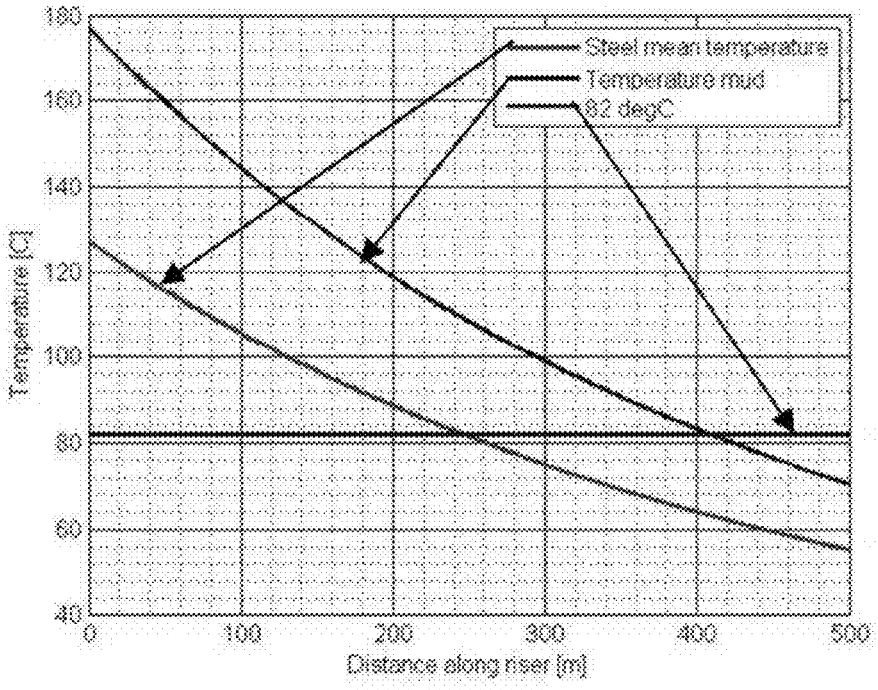
FIG. 7 shows a plot of drilling mud temperature and pipe steel temperature vs. riser length for a riser without the cooling device of the present invention.
Figure 8:
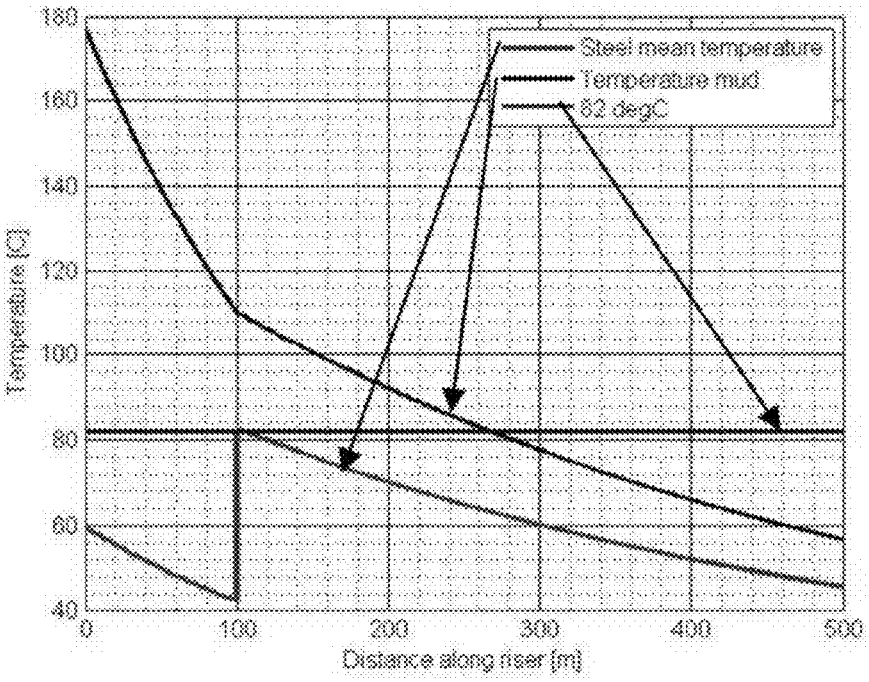
FIG. 8 shows a plot of drilling mud temperature and pipe steel temperature vs. riser length for a riser with the cooling device of the present invention.

The heat exchanger 10, including the cooling fins 11, increase the effective surface area that is exposed to the surrounding seawater compared to that of the pipe without the heat exchanger 10. This effect is shown in FIGS. 7 and 8 which show the change in temperature with increasing distance from the wellhead 3 for the drilling mud and for the pipe steel (typically auxiliary line pipe). FIG. 7 shows temperature profiles for a riser having pipes coated with a typical epoxy-based paint. FIG. 8 shows temperature profiles for a riser having a heat exchanger 10 (i.e., cooling device 10) according to the present invention connected to the pipe between the wellhead 3 and a distance of 100 meters above the wellhead 3.

Figure 10:
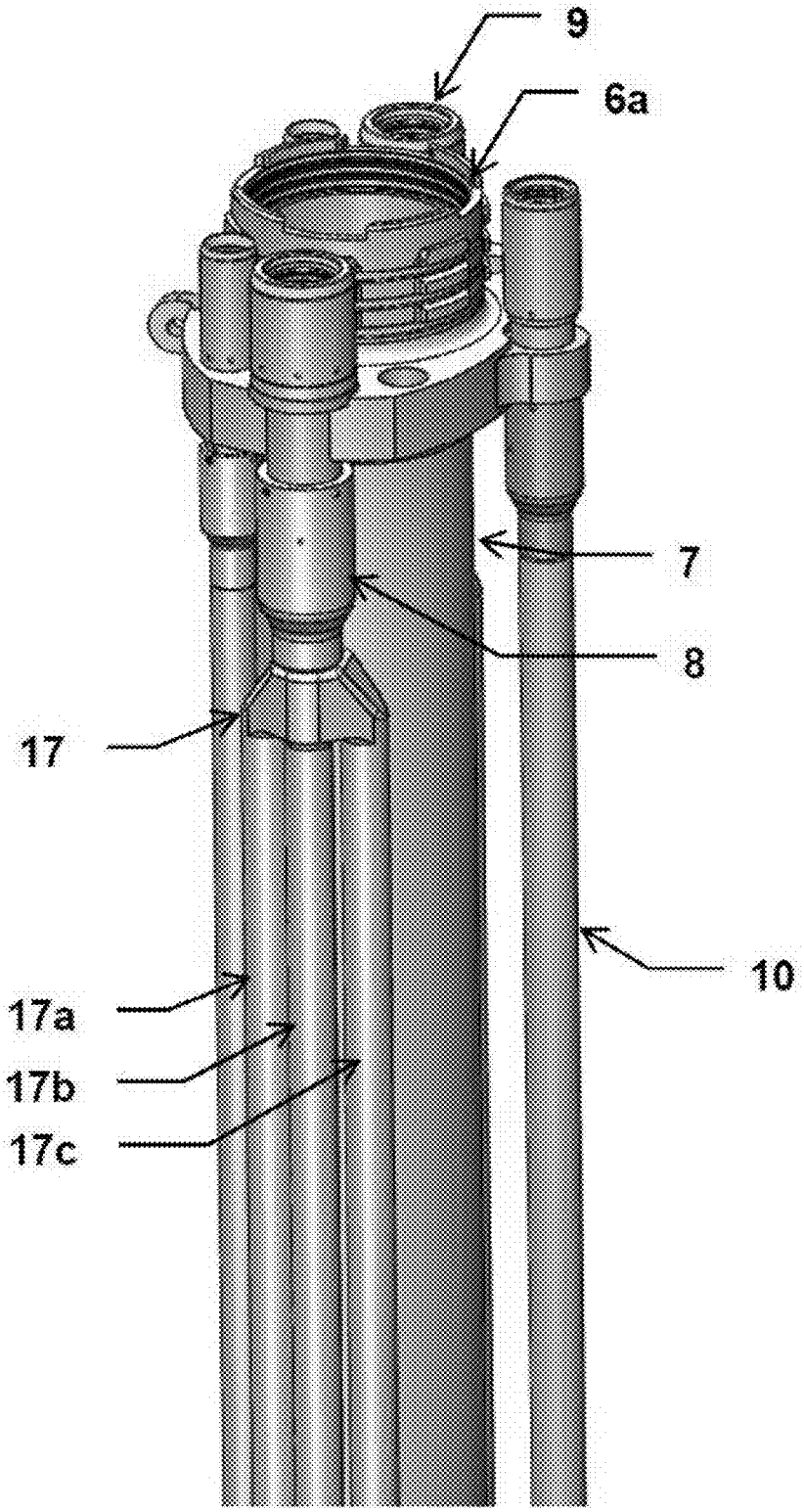
FIG. 10 shows a perspective view of a portion of a riser joint on which one of the auxiliary lines is furnished with a second embodiment of the cooling device of the present invention comprising three individual branch pipes.
Figure 11:
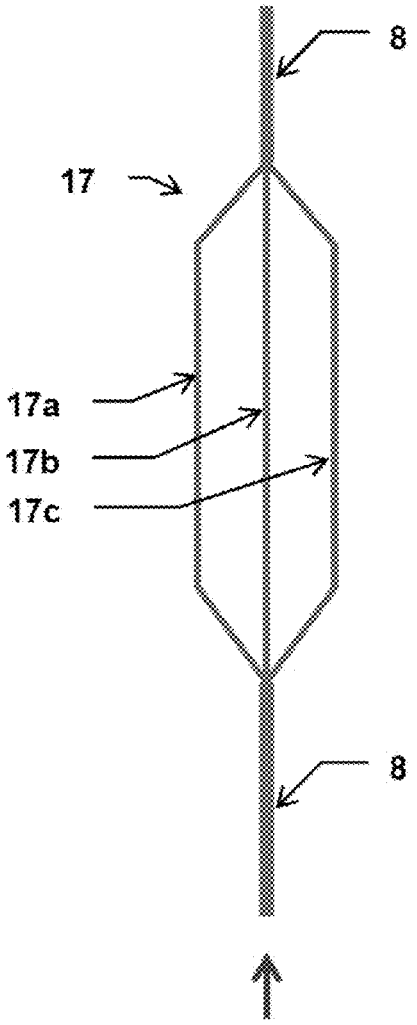
FIG. 11 shows a principle sketch of the second embodiment of the cooling device of the present invention.

FIGS. 10 and 11 illustrate a second embodiment in which a portion of the auxiliary line 8 in a riser joint has been replaced by a second heat exchanger 17 which comprises a plurality (three in the shown embodiment) of branch pipes 17 *a-c*. The branch pipes 17 *a-c* are of material with good heat transfer capabilities, such as aluminum or stainless steel. The plurality of branch pipes 17 *a-c* serve to increase the effective wetted area (i.e., the surface area exposed to the surrounding seawater) of the auxiliary line and thus improve the heat transfer.

Figure 12:
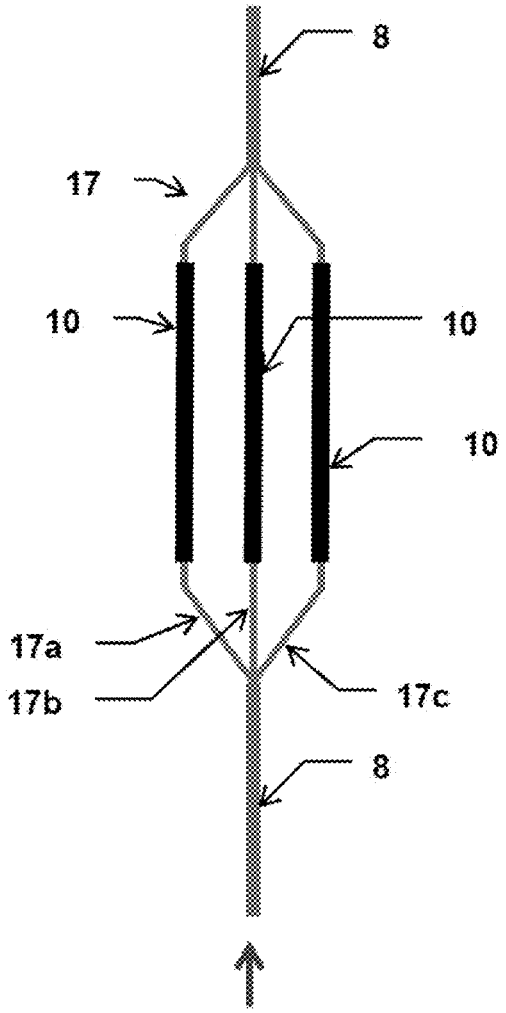
FIG. 12 shows a principle sketch of an embodiment in which the first and second embodiments are combined.

In FIG. 12, a portion of each of the branch pipes 17 *a-c* is furnished with a respective (first) heat exchanger 10 of the kind described above with reference to FIGS. 3 to 6. This embodiment is considered a further improvement of the embodiment shown in FIG. 11.

Calculations show that the heat dissipation for the embodiment illustrated in FIG. 11 is considerably higher than the heat dissipation in a prior art auxiliary pipe. The embodiment illustrated in FIG. 12 exhibits an even higher heat dissipation.

Although the present invention has been described with reference to an auxiliary pipe, it should be understood that, unless otherwise noted, the present invention is equally applicable for assembly into a main riser pipe 7.

While the riser joint 5*a*, with the heat exchangers 10, 17 described above, may in principle be fitted anywhere in the riser 2, this riser joint 5*a* may, for example, be installed as the lowermost riser joint, i.e., closest to the wellhead 3, for high-temperature operations.

It is possible with the present invention to assemble a riser in which one (or more) of the lowermost riser joints comprise metal pipes and are furnished with the cooling device of the present invention, and the remaining riser joints (for example, all the way up to the vessel; see FIG. 1) have pipes made of light-weight (for example, carbon-reinforced composites) materials. The present invention thus furthermore comprises a compound riser having one or more riser joints of a material capable of withstanding high temperatures and being fitted with the cooling devices and where the remaining riser joints are of a light-weight material that requires lower temperatures.

The present invention is not limited to embodiments described herein; reference should be had to the appended claims.

What is claimed is:

1. A marine riser comprising:

at least two riser sections which are connected in an end-to-end relationship, the at least two riser sections being configured to extend between a subsea installation and a suspension device arranged above the subsea installation, at least one of the at least two riser sections comprising at least one pipe which comprises a heat exchanger, wherein, the heat exchanger comprises a support casing and a plurality of radially extending fins which extend radially from the support casing, the heat exchanger being configured to be assembled on a portion of the at least one pipe.

2. The marine riser as recited in claim 1, wherein the heat exchanger is configured to be releasably connected to the at least one pipe.

3. The marine riser as recited in claim 1, wherein the radially extending fins are configured to extend in an axial direction along the support casing.

4. The marine riser as recited in claim 3, wherein the radially extending fins are integral with the support casing.

5. The marine riser as recited in claim 1, wherein the support casing comprises a tubular body.

6. The marine riser as recited in claim 5, wherein, the support casing comprises two support casing halves and a connection device, and the two casing halves are configured to be interconnectable via the connection device to form the tubular body.

7. The marine riser as recited in claim 1, wherein the heat exchanger further comprises a covering element which is arranged circumferentially around radially outer ends of the plurality of radially extending fins.

8. The marine riser as recited in claim 1, further comprising a second heat exchanger comprising a plurality of branch pipes which are fluidly connected to the at least one pipe.

9. The marine riser as recited in claim 8, wherein the heat exchanger is connected to a part of the plurality of branch pipes of the second heat exchanger.

10. The marine riser as recited in claim 8, wherein, the at least one of the at least two riser sections is a first riser section which is located closer to the subsea installation than remaining riser sections of the at least two riser sections, and at least one of the heat exchanger and the second heat exchanger is attached to at least one of the at least one pipe of the first riser section.

11. The marine riser as recited in claim 10, wherein, the at least one pipe of the first riser section comprises a metal material, and the at least one pipe of the remaining riser sections of the at least two riser sections comprises a composite material.

12. The marine riser as recited in claim 11, wherein, the at least one pipe of the first riser section comprises aluminum or steel, and the at least one pipe of the remaining riser sections of the at least two riser sections comprises a carbon-reinforced polymer.

13. The marine riser as recited in claim 12, wherein the carbon-reinforced polymer is epoxy.

14. The marine riser as recited in claim 1, wherein, the at least one pipe includes a main pipe and a kill-and-choke line, and each of the at least two riser sections comprises each of the main pipe and the kill-and-choke line.

15. A marine riser comprising:

at least two riser sections which are connected in an end-to-end relationship, the at least two riser sections being configured to extend between a subsea installation and a suspension device arranged above the subsea installation, at least one of the at least two riser sections comprising at least one pipe which comprises a heat exchanger, wherein, the heat exchanger comprises a support casing which is configured to be assembled on a portion of the at least one pipe, the support casing comprises a tubular body, the support casing comprises two support casing halves and a connection device, and the two casing halves are configured to be interconnectable via the connection device to form the tubular body.

16. The marine riser as recited in claim 15, wherein the heat exchanger is configured to be releasably connected to the at least one pipe.

17. A marine riser comprising:

at least two riser sections which are connected in an end-to-end relationship, the at least two riser sections being configured to extend between a subsea installation and a suspension device arranged above the subsea installation, at least one of the at least two riser sections comprising at least one pipe which comprises a first heat exchanger, a second heat exchanger, an uppermost end, and a lowermost end, wherein, the second heat exchanger comprises a plurality of branch pipes, and each of the plurality of branch pipes is fluidly connected to the uppermost end and to the lowermost end of the at least one pipe.

18. The marine riser as recited in claim 17, wherein the first heat exchanger is connected to a part of the plurality of branch pipes of the second heat exchanger.

19. The marine riser as recited in claim 17, wherein, the at least one of the at least two riser sections is a first riser section which is located closer to the subsea installation than remaining riser sections of the at least two riser sections, and at least one of the first heat exchanger and the second heat exchanger is attached to at least one of the at least one pipe of the first riser section.

20. The marine riser as recited in claim 19, wherein, the at least one pipe of the first riser section comprises a metal material, and the at least one pipe of the remaining riser sections of the at least two riser sections comprises a composite material.

21. The marine riser as recited in claim 20, wherein, the at least one pipe of the first riser section comprises aluminum or steel, and the at least one pipe of the remaining riser sections of the at least two riser sections comprises a carbon-reinforced polymer.

22. The marine riser as recited in claim 21, wherein the carbon-reinforced polymer is epoxy.

23. The marine riser as recited in claim 17, wherein, the at least one pipe includes a main pipe and a kill-and-choke line, and each of the at least two riser sections comprises each of the main pipe and the kill-and-choke line.

* * * * *